US009528208B2

(12) United States Patent
Keene

(10) Patent No.: US 9,528,208 B2
(45) Date of Patent: Dec. 27, 2016

(54) INTERLOCKING POLYMERIC MATTING ARTICLE

(71) Applicant: Keene Building Products Co., Inc., Mayfield Heights, OH (US)

(72) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 0 days.

(21) Appl. No.: 14/787,070

(22) PCT Filed: Apr. 29, 2014

(86) PCT No.: PCT/US2014/035843
§ 371 (c)(1),
(2) Date: Oct. 26, 2015

(87) PCT Pub. No.: WO2014/179290
PCT Pub. Date: Nov. 6, 2014

(65) Prior Publication Data

US 2016/0083881 A1 Mar. 24, 2016

Related U.S. Application Data

(60) Provisional application No. 61/816,975, filed on Apr. 29, 2013.

(51) Int. Cl.
*D04H 3/16* (2006.01)
*B65D 81/02* (2006.01)
(Continued)

(52) U.S. Cl.
CPC ..... *D04H 3/16* (2013.01); *B65D 81/02* (2013.01); *D04H 1/54* (2013.01); *D04H 3/007* (2013.01);
(Continued)

(58) Field of Classification Search
CPC ..... Y10T 428/42279; Y10T 428/24479; Y10T 428/24785; Y10T 428/24636; D04H 3/16; D04H 3/14; D04H 1/54; D04H 3/005; D04H 3/007; D04H 3/009; F24F 13/24; F24F 2013/242; B65D 81/02; F16L 59/023; F16L 59/028; F16L 59/02; F16L 59/025; F16L 59/024; F16L 59/022; F16L 59/021
(Continued)

(56) References Cited

U.S. PATENT DOCUMENTS 7,730,685 B1 6/2010 Keene
2004/0045242 A1* 3/2004 Lake ..... B32B 5/02 52/396.02
(Continued)

FOREIGN PATENT DOCUMENTS

DE 25 41 373 A1 3/1977
GB 877 253 A 9/1961
(Continued)

OTHER PUBLICATIONS

Translation of JP2002-000407.*
(Continued)

*Primary Examiner* — Catherine A Simone
(74) *Attorney, Agent, or Firm* — Renner, Otto, Boisselle & Sklar, LLP

(57) ABSTRACT

A polymeric matting article includes a web of extruded polymer monofilaments, the polymer monofilaments being heat welded at junctions to form a matrix of tangled monofilament; and at least one pair of interlocking formations; wherein the web is configured to be foldable onto itself and secured in a folded position by engaging the interlocking formations.

6 Claims, 3 Drawing Sheets

(51) Int. Cl.

| | |
|---|---|
| ***F24F 13/24*** | (2006.01) |
| ***D04H 1/54*** | (2012.01) |
| ***D04H 3/007*** | (2012.01) |
| ***D04H 3/009*** | (2012.01) |
| ***D04H 3/011*** | (2012.01) |

(52) U.S. Cl.
CPC ..... *D04H 3/009* (2013.01); *D04H 3/011* (2013.01); *F24F 13/24* (2013.01); *F24F 2013/242* (2013.01)

(58) Field of Classification Search
USPC ..... 428/156, 121, 130
See application file for complete search history.

(56) References Cited

U.S. PATENT DOCUMENTS

| | | | | |
|---|---|---|---|---|
| 2011/0189940 | A1* | 8/2011 | Kerwood-Winslow | E04D 13/17 454/365 |
| 2012/0183744 | A1 | 7/2012 | Keene | |
| 2012/0279153 | A1 | 11/2012 | Keene | |

FOREIGN PATENT DOCUMENTS

| | | | |
|---|---|---|---|
| JP | 2002-000407 | A | 1/2002 |
| WO | 98/57795 | A1 | 12/1998 |

OTHER PUBLICATIONS

Database WPI, Week 200230, Thomson Scientific, London, GB, JP 2002-000407 A dated Jan. 8, 2002, Guno Seni Kogyo KK, Abstract, 3 pages.

International Search Report and Written Opinion for corresponding International Application No. PCT/US2014/035843 dated Sep. 12, 2014.

Reply to International Search Report and Written Opinion for corresponding International Application No. PCT/US2014/035843dated Feb. 26, 2015.

Written Opinion of the International Preliminary Examining Authority for corresponding International Application No. PCT/US2014/035843 dated Apr. 7, 2015.

International Preliminary Report on Patentability for corresponding International Application No. PCT/US2014/035843 dated Jul. 7, 2015.

* cited by examiner

INTERLOCKING POLYMERIC MATTING ARTICLE

This application is a national phase of International Application No. PCT/US2014/035843 filed Apr. 29, 2014 and published in the English language, which claims priority to U.S. Provisional Application No. 61/816,975 filed Apr. 29, 2013.

TECHNICAL FIELD

The present invention relates to a polymeric matting article, and in particular, to a polymeric matting article configured to be foldable onto itself and secured in a folded position by engaging interlocking formations.

SUMMARY

In one aspect of the invention there is provided a polymeric matting article that includes a web of extruded polymer monofilaments, the polymer monofilaments being heat welded at junctions to form a matrix of tangled monofilament; and at least one pair of interlocking formations; wherein the web is configured to be foldable onto itself and secured in a folded position by engaging the interlocking formations.

The extruded polymer monofilaments of the matting article may be composed of a polyolefin, polyamide, polyester, polyvinylhalide, polystyrene, polyvinylester, or a mixture of two or more thereof.

In one embodiment, the interlocking formations include an elongated rib and a complementary elongated channel into which the elongated rib fits in a folded position.

In one embodiment, the web of extruded polymer monofilaments includes top and bottom shell halves and a hinge integrally formed with and interconnecting the top and bottom shell halves, the top and bottom shell halves cooperatively defining a filament free cavity.

In one embodiment, the polymeric matting article is a packaging material.

In another embodiment, the polymeric matting article is a building construction material.

DETAILED DESCRIPTION

Figure 1:
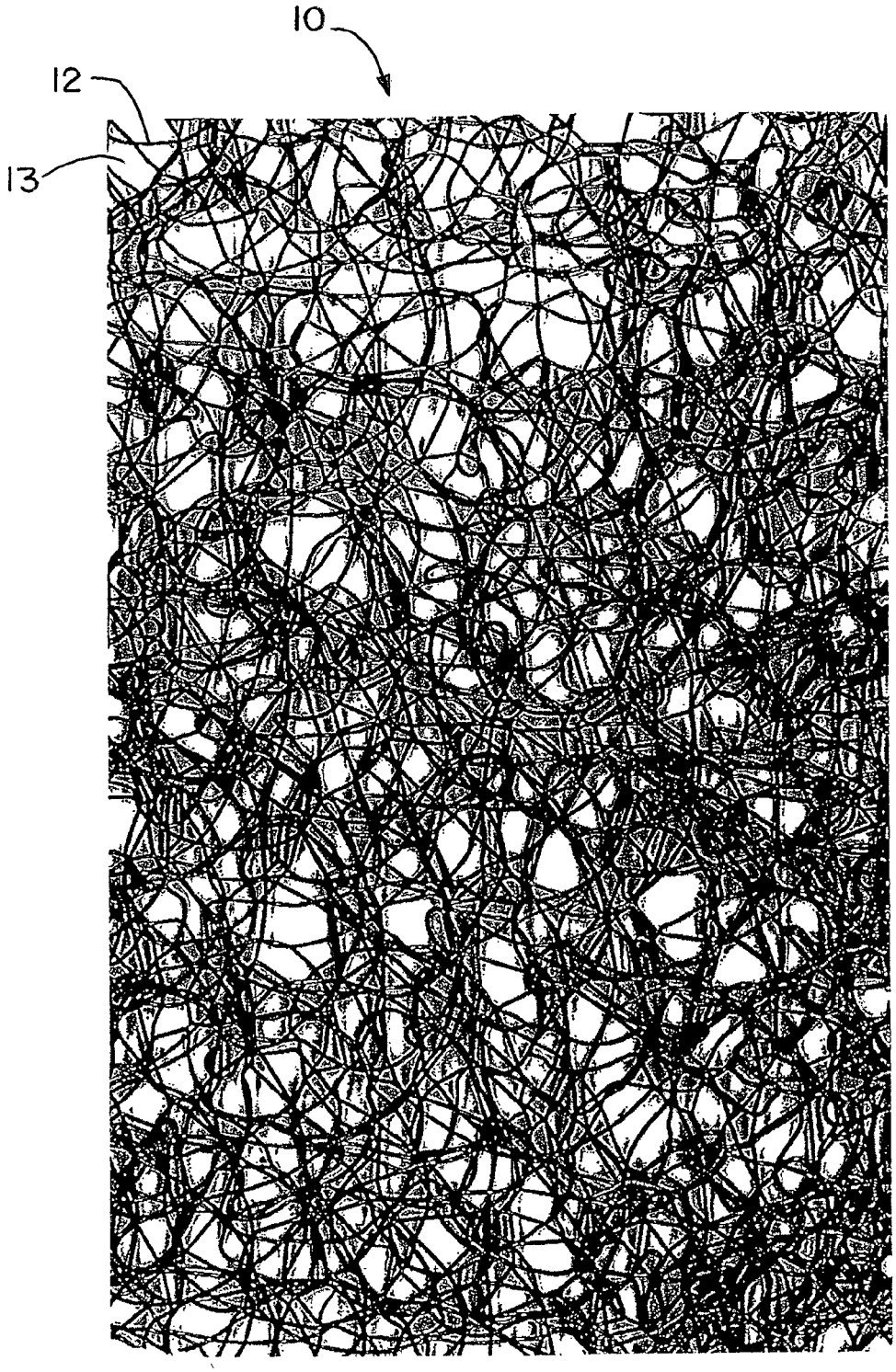
FIG. 1 is a top view of a portion of the polymeric matting article formed from tangled polymer filaments.

The polymeric matting article of the present invention is formed from a web of extruded polymer monofilaments. The fibrous web is extruded onto a substrate having a surface profile corresponding to that of the desired matting article, the matting article configured to be foldable onto itself and secured in a folded position by engaging interlocking formations Referring to FIG. 1, a portion of the matting article is shown. The matting article is constructed of a web 10 formed from a plurality of extruded polymer monofilaments 12. The plurality of filaments 12 that are heat fused to one another at randomly spaced points to form a three-dimensional, convoluted and mutually interconnected filamentatious body having an open structure. Filament free voids 13 are formed within the resilient structure, which allows air flow within the structure while allowing the structure to absorb impacts. The polymer filament material is preferably constructed in accordance with techniques such as disclosed by, for example, U.S. Pat. Nos. 3,687,759; 3,691,004; and 4,212,692, the contents of all of which are hereby incorporated by reference in their entireties.

The monofilaments 12 of web 10 may be made from any thermoplastic polymer that provides the desired properties of strength and resilience for the application in which it is used. For example, the monofilaments 41 may be made of a polyolefin (e.g., polyethylene, polypropylene, etc.), polyamide (e.g., Nylon), polyester, polyvinylhalide (e.g., polyvinylchloride (PVC), polyvinylidene chloride, polyvinyltetrafluoride, polyvinyl chlorotrifluoride), polystyrene, polyvinylester (e.g., polyvinyl acetate, etc.) or a mixture of two or more thereof. The monofilaments 12 are extruded onto a substrate having the desired structural profile to form the web 10.

Figure 2A:
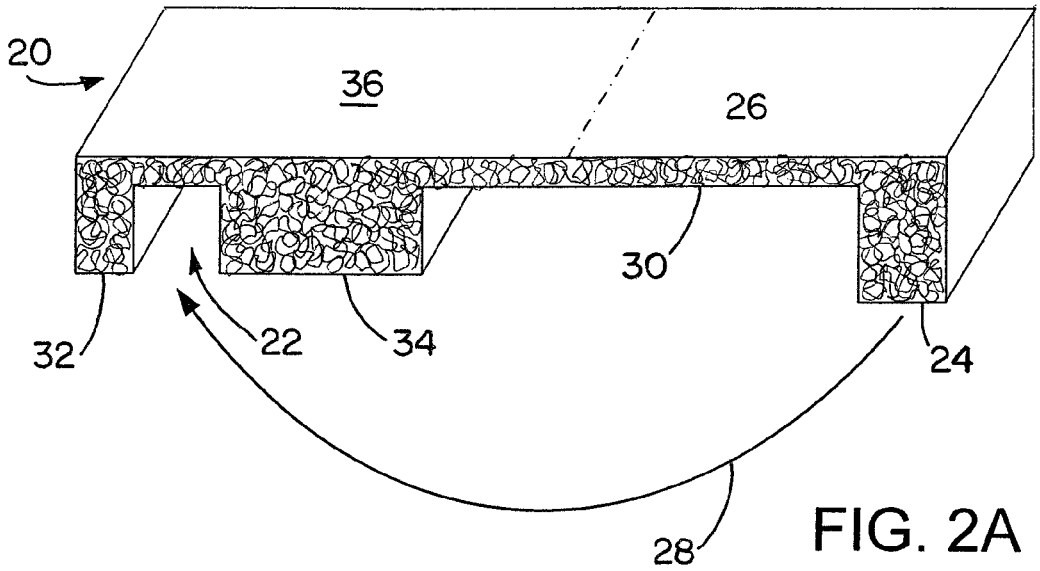
FIGS. 2A and 2B are perspective views of an embodiment of the polymeric matting article having an elongated rib and a complementary elongated channel in an unfolded position and in a folded position, respectively, in accordance with the present invention.
Figure 2B:
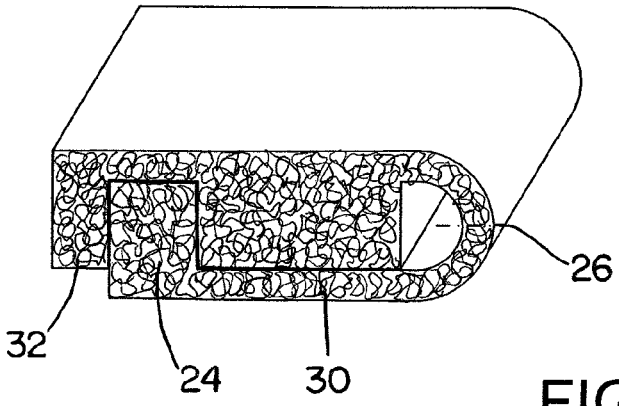

Referring to FIGS. 2A and 2B, in one embodiment the matting article 20 includes an elongated channel 22 positioned between a first raised region 32 and a second raised region 34, the raised regions 32 and 34 including a thickness of entangled filaments extending from the a first surface 36 of the matting article. The second raised region 34 is closest to the fold line 26 and is adjacent a flat planar region 30 on the opposite side of the fold line 26. Adjacent the flat planar region 30 is an elongated rib 24 having a width that is the same or less than the width of the elongated channel 22. The matting article 20 is illustrated in FIG. 2A in its unfolded position. Arrow 28 indicates the fold direction of the matting article 20. The matting article 20 is illustrated in FIG. 2B in its folded position. Upon folding the matting article 20 along fold line 26 in the folding direction, the elongated rib 24 fits into and engages the elongated channel 22 to form a device having a uniform thickness. The device may be, for example, a lightweight, resilient building construction device. The building construction device being useful for providing, for example, cushioning, drainage, air circulation and/or sound damping when included as part of a building structure.

Figure 3A:
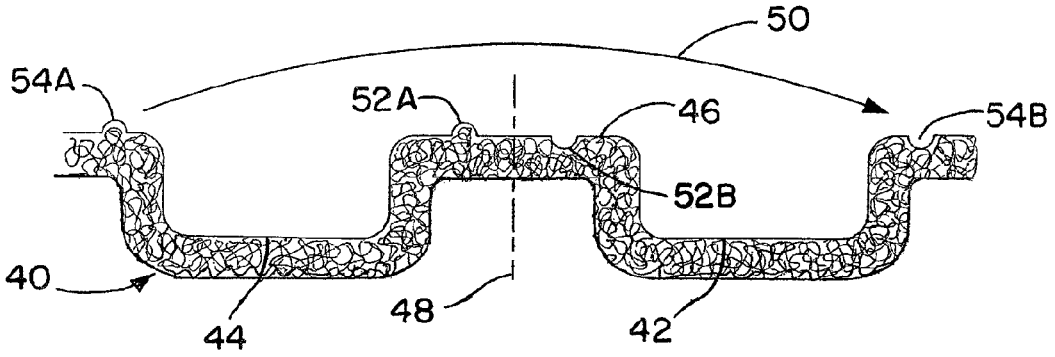
FIGS. 3A and 3B are cross-sectional views of an embodiment of the polymeric matting article having a clam shell configuration with complementary interlocking domes in an unfolded and folded position, respectively.
Figure 3B:
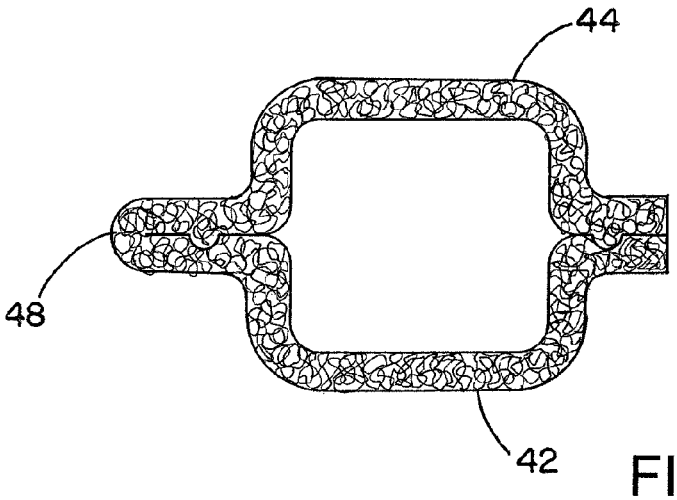

Referring to FIGS. 3A and 3B, in one embodiment the matting article 40 has a clam shell configuration, including a bottom shell half 42 and a top shell half 44 that are connected by connecting section 46. Matting article 40 is illustrated in FIG. 3A in the unfolded, or open position. The bottom shell half 42 has an outer lip 56 that includes a downwardly facing locking dome 54B. The top shell half 44 has an outer lip 58 that includes an upwardly facing locking dome 54A, which is complementary to locking dome 54B. The connecting section 46, which acts as a flexible hinge for the matting article 40, includes a pair of complementary interlocking domes 52A and 52B positioned on opposing sides of fold line 48. Arrow 50 indicates the fold direction of the matting article 40. FIG. 3B illustrates the matting article 40 in the folded, or closed position. Upon folding the matting article 40 along fold line 48 in the folding direction, dome 52A engages dome 52B and dome 54A on the outer lip 58 of the top shell half engages dome 54B on the outer lip 56 of the bottom shell half to secure the matting article in a closed position. Matting article 40 may be useful, for example, as a packaging material or as a building construction component for drainage and/or air circulation.

While the invention has been explained in relation to various embodiments, it is to be understood that various modifications thereof will become apparent to those skilled in the art upon reading this specification. Therefore, it is to be understood that the invention provided herein is intended to cover such modifications as may fall within the scope of the appended claims.

The invention claimed is:

1. A polymeric matting article comprising:

a web of extruded polymer monofilaments, the polymer monofilaments being heat welded at junctions to form a matrix of tangled monofilament; and at least one pair of complementary interlocking formations positioned on opposing sides of a fold line and configured to engage each other to secure the web in a folded position along the fold line.

2. The polymeric matting article of claim 1, wherein the extruded polymer monofilaments comprise a polyolefin, polyimide, polyester, polyvinylhalide, polystyrene, polyvinylester, or a mixture of two or more thereof.

3. The polymeric matting article of claim 1, wherein the interlocking formations comprise an elongated rib and a complementary elongated channel into which the elongated rib fits in a folded position.

4. The polymeric matting article of claim 1, wherein the web comprises top and bottom shell halves and a hinge integrally formed with and interconnecting the top and bottom shell halves, the top and bottom shell halves cooperatively defining a filament free cavity.

5. A packaging material comprising the polymeric matting article of claim 4.

6. A building construction material comprising the polymeric matting article of claim 1.

* * * * *